United States Patent [19]

Theurer

[11] Patent Number: 4,835,887

[45] Date of Patent: Jun. 6, 1989

[54] MOBILE MACHINE FOR DISTRIBUTING AND SHAPING THE BALLAST BED OF A RAILROAD TRACK

[75] Inventor: Josef Theurer, Vienna, Austria

[73] Assignee: Franz Plasser Bahnbaumaschinen-Industriegesellschaft m.b.H., Vienna, Austria

[21] Appl. No.: 210,922

[22] Filed: Jun. 24, 1988

[30] Foreign Application Priority Data

Oct. 20, 1987 [AT] Austria ..... 2768/87

[51] Int. Cl.[4] ..... E01B 27/04

[52] U.S. Cl. ..... 37/104

[58] Field of Search ..... 37/104–107, 37/198, 207, 214, 215, 216

[56] References Cited

U.S. PATENT DOCUMENTS

| | | | |
|---|---|---|---|
| 2,665,506 | 1/1954 | Kershaw | 37/104 |
| 3,019,536 | 2/1962 | Kershaw | 37/104 |
| 3,080,665 | 3/1963 | Keller et al. | 37/104 |
| 3,091,187 | 5/1963 | Christoff | 37/104 |
| 3,305,952 | 2/1967 | Dressler | 37/104 |
| 3,491,407 | 1/1970 | Finger | 37/104 |
| 3,877,160 | 4/1976 | Plasser et al. . | |
| 4,102,066 | 7/1978 | Christoff | 37/104 |
| 4,227,324 | 10/1980 | Theurer | 37/104 |
| 4,249,325 | 2/1981 | Theurer | 37/104 |
| 4,266,351 | 5/1981 | Cox | 37/104 |
| 4,282,663 | 8/1981 | Theurer | 37/104 |

FOREIGN PATENT DOCUMENTS 378795 2/1985 Austria .

*Primary Examiner*—Eugene H. Eickholt
*Attorney, Agent, or Firm*—Kurt Kelman

[57] ABSTRACT

A mobile machine for distributing and shaping the ballast bed of a railroad track comprises a machine frame, and a ballast plow arrangement comprising a ballast planing plow including two vertically adjustable center plowshares arranged between the rails and a respective rail-bridging tunnel-shaped element associated with each rail and embracing the associated rail. A vertically adjustable, transversely extending ballast scraping and damming wall is arranged between the tunnel-shaped elements immediately behind the center plowshares in the operating direction, the wall having an upper edge, and a conveyor band is arranged immediately behind the ballast scraping and damming wall for removing any ballast flowing over the upper edge of the wall.

11 Claims, 2 Drawing Sheets

MOBILE MACHINE FOR DISTRIBUTING AND SHAPING THE BALLAST BED OF A RAILROAD TRACK

BACKGROUND OF THE INVENTION (1) Field of the Invention

The present invention relates to a mobile machine for distributing and shaping the ballast bed of a railroad track consisting of two rails fastened to ties, which comprises a machine frame, two undercarriages supporting the machine frame on the track for mobility thereon in an operating direction, and a ballast plow arrangement comprising a ballast planing plow including two vertically adjustable center plowshares arranged between the rails and a respective rail-bridging tunnel-shaped element associated with each rail and embracing the associated rail.

(2) Description of the Prior Art

U.S. Pat. No. 3,877,160, dated Apr. 15, 1975, discloses such a mobile ballast distributing and shaping machine. The ballast planing plow is mounted between the undercarriages and comprises an X-shaped, vertically adjustable center plow and two parallel rail-bridging tunnel-shaped elements. Three plowshares are arranged at the center of the center plow and are pivotal about a common vertical axis. Each tunnel-shaped element is connected with two transverse plowshares extending obliquely to the tunnel-shaped elements and these plowshares may be aligned with respective ones of the plowshares at the center of the center plow to constitute extensions thereof. A respective side plowshare is pivoted to an outer end of each transverse plowshare for pivoting about a vertical axis. At each side of the machine, a shoulder plow precedes the center plow for shaping the track shoulders. A ballast storage container with an hydraulically operable ballast discharge device is mounted on the machine frame immediately behind the center plow in the operating direction. An elevator conveyor band for conveying ballast is arranged between a broom arrangement at a rear end of the machine frame and a top of the ballast storage container. During operation of the machine, the two shoulder plows move the ballast in the track shoulders up in the direction of the center plow where the ballast is directed, depending on the positioning of the center plowshares, to each or one of the tie end regions. Any excess ballast is swept by the broom arrangement onto the conveyor band which conveys it into the storage container. While this ballast plow machine has been successfully used in track maintenance and rehabilitation work, the arrangement of a ballast storage container and a conveyor band feeding ballast thereto is not always suitable. In addition, the discharge of ballast from the storage container must be controlled by an operator, requiring additional personnel.

Austrian patent No. 378,795, published Feb. 15, 1985, discloses a ballast plow with a plow arrangement between the undercarriages of the machine frame and a ballast broom arranged at the rear end thereof. A transversely extending conveyor band precedes the ballast broom so that any excess ballast swept up by the broom is received by the conveyor band and is discharged on the ballast shoulder. This machine has also been successfully used but it often leaves cribs filled with insufficient amounts of ballast.

SUMMARY OF THE INVENTION

It is the primary object of this invention to improve a mobile machine of the type described in the opening paragraph of the specification so that cribs of substantially different ballast densities may be substantially uniformly filled with ballast and planed.

The above and other objects and advantages are accomplished according to the invention with such a machine which comprises a vertically adjustable, transversely extending ballast scraping and damming wall arranged between the tunnel-shaped elements immediately behind the center plowshares in the operating direction, the wall having an upper edge, and means arranged immediately behind the ballast scraping and damming wall for removing any ballast flowing over the upper edge of the wall.

The ballast scraping and damming wall in cooperation with the pivotal center plowshares provides a storage of ballast with relatively simple structural means. Any excess ballast automatically dammed and stored behind the transversely extending wall will automatically fill such cribs which are filled with ballast below average density so that, regardless of the ballast densities in the successive cribs before the machine distributes and shapes the ballast, the cribs will be uniformly filled with ballast after operation of the machine. The arrangement of the ballast removing means immediately behind the ballast scraping and damming wall has the advantage that any excess ballast overflowing the wall is removed so that such excess ballast may be discharged immediately on the track shoulder, for example. Thus, with a minimum of additional structure, the ballast plow of the present invention can store accurately determinable amounts of ballast while removing excess ballast so as to enhance the operational efficiency of the machine.

BRIEF DESCRIPTION OF THE DRAWING

The above and other features and advantages of this invention will become more apparent from the following detailed description of a now preferred embodiment thereof, taken in conjunction with the accompanying somewhat schematic drawing wherein.

DETAILED DESCRIPTION OF THE PREFERRED EMBODIMENT

Figure 1:
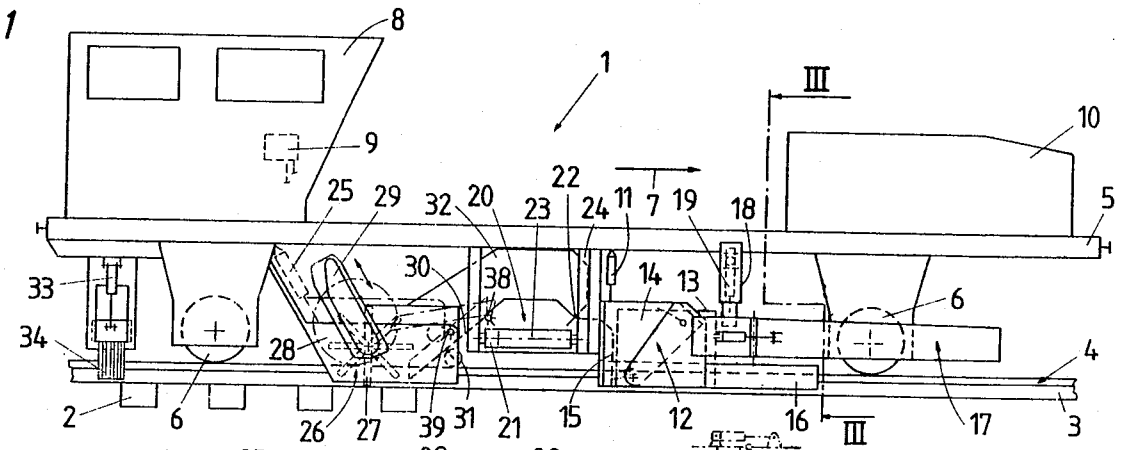
FIG. 1 is a side view of a mobile machine for distributing and shaping a ballast bed.
Figure 2:
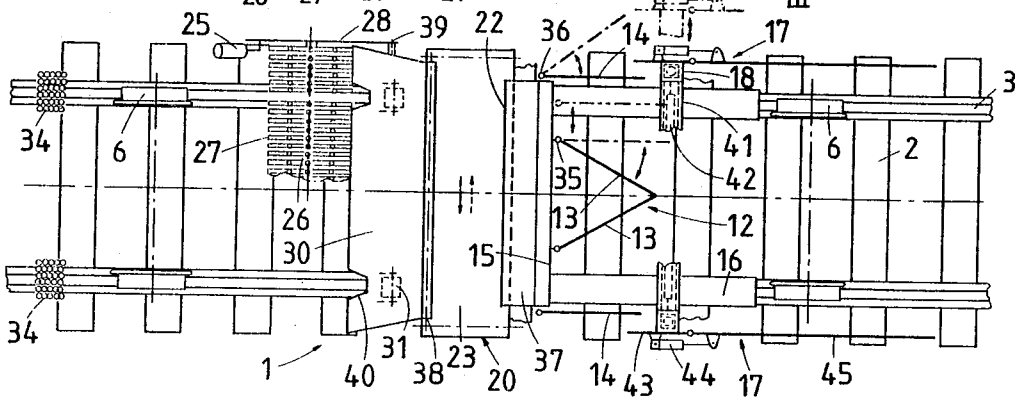
FIG. 2 is a fragmentary top view of the mobile machine of FIG. 1.

Referring now to the drawing and first to FIGS. 1 and 2, there is shown mobile machine 1 for distributing and shaping the ballast bed of railroad track 4 consisting of two rails 3 fastened to ties 2. The machine comprises machine frame 5 and two undercarriages 6 supporting the machine frame on track 4 for mobility thereon in an operating direction indicated by arrow 7. A rear end of the machine frame carries operator's cab 8 housing central control panel 9 while power plant 10 comprising a motor with hydraulic pumps is mounted on a front end of machine frame 5. A ballast plow arrangement is arranged immediately behind front undercarriage 6 and comprises a ballast planing plow including two vertically adjustable center plowshares 13 arranged between rails 3 and a respective rail-bridging tunnel-shaped element 16 associated with each rail and embracing the associated rail. Vertically adjustable, transversely extending ballast scraping and damming wall 15 is arranged between tunnel-shaped elements 16 immediately behind center plowshares 13 in the operating direction and this wall has upper edge 22. Means 20 is arranged immediately behind ballast scraping and damming wall 15 for removing any ballast flowing over upper edge 22 of wall 15.

In the illustrated embodiment, the ballast scraping and damming wall is connected to the ballast planing plow for common vertical adjustment by hydraulic drives 11 connecting the ballast plow arrangement to machine frame 5 and the wall extends over the entire transverse distance between tunnel-shaped elements 16. With such a unit, the ballast is uniformly dammed behind wall 15 over the entire width of the track between rails 3. In addition, lowering of the ballast planing plow into its operating position will automatically position the ballast scraping and damming wall for proper operation.

Ballast scraping and damming wall 15 preferably has a vertical height at least twice the height of tunnel-shaped elements 16, and center plowshares 13 have a vertical height exceeding the height of the wall. Such dimensioning will assure the formation of a sufficient amount of ballast dammed behind wall 15 while a higher wall would cause too much ballast to be accumulated behind the advancing wall and thus generate undue resistance to the forward movement of the machine along the track. The indicated height of the center plowshares relative to the wall will prevent the accumulated ballast behind wall 15 to flow over the upper edges of plowshares 13.

As shown, means 20 for removing any ballast overflowing upper edge 22 of wall 15 comprises conveyor band 23 extending transversely below upper wall edge 22 and having a length corresponding at least to the length of the wall, and drive 21 for moving the conveyor band. Carrier beams 24 mount the conveyor band on machine frame 5. With this arrangement, overflowing ballast will be rapidly and efficiently removed to the track shoulders, the overflowing ballast simply dropping over upper wall edge 22 onto conveyor band 23 by gravity. The plow arrangement, ballast scraping and damming wall 15 and means 20 for removing any ballast flowing over upper wall edge 22 are arranged between undercarriages 6 and are connected to machine frame 5. This centered arrangement gives an operator in cab 8 a particularly good view and, furthermore, the ballast plows will be automatically centered with respect to the track even in sharp curves.

In the illustrated embodiment, side plowshares 14 precede ballast scraping and damming wall 15 in the operating direction and are transversely spaced from each center plowshare 13, side plowshares 14 being pivotal about vertical axes for lateral adjustment (see full and chain-dotted lines in FIG. 2), and vertically and transversely adjustable shoulder plow 17 precedes ballast plow arrangement 13, 14 in the operating direction. Each elongated shoulder plowshare 45 is connected to hydraulic drive 19 for vertical adjustment, the vertical adjustment drive extending telescopingly in vertical guide 18. Furthermore, a transverse guide 41 telescopingly receives hydraulic drives 42 connected to the shoulder plowshares for transversely displacing the same, as shown in chain-dotted lines in FIG. 2. Pivoting hydraulic drives 44 connect shoulder plowshares 45 to plates 43 affixed to vertical guides 18 for pivoting the shoulder plowshares into adjusted lateral positions. This combination of ballast scraping and damming wall 15, center and side plowshares 13, 14 and preceding shoulder plow 17 enables the machine to channel and deflect the ballast in various ways for shaping the ballast bed in a desired manner under given ballast conditions, wall 15 always assuring a sufficient amount of stored ballast for uniformly filling the cribs.

A vertically adjustable broom arrangement is mounted behind ballast plow arrangement 13, 14, ballast scraping and damming wall 15 and conveyor band 23, and drive means 25 vertically adjustably connects the broom arrangement to machine frame 5. The broom arrangement comprises transversely extending rotary ballast broom 26 having a length corresponding to that of ties 2 and radially extending sweeping hose elements 27 for sweeping ballast off the surfaces of the ties. Carrier frame 28 supports ballast broom 26 and vertical adjustment drives 25 for the broom arrangement connect one end of the carrier frame to machine frame 5. Drive 29 imparts a rotary motion to the ballast broom. The broom arrangement rearwardly of ballast plow arrangement 12 enables any ballast remaining on the ties and flowing under the lower edge of wall 15 to be rapidly and fully removed.

A transversely extending ballast scraping sheet metal member 30 is arranged between conveyor band 23 and broom 26, and rollers 31 supporting the ballast scraping sheet metal member on track rails 3. Sheet metal member 30 enables all the ballast swept up by broom 26 to be moved up onto conveyor band 23 which then removes it to the track shoulder, together with any ballast overflowing upper wall edge 22. The support of sheet metal member 30 by rollers 31 on rails 3 will automatically position the lower edge of the sheet metal member at a desired distance from the upper surfaces of ties 2, regardless of the height of the rails. A respective sheet metal guide member 32 is mounted at each side of ballast scraping sheet metal member 30 between broom 26 and wall 15 to prevent ballast from spilling over the sides of member 30. Two transversely spaced, vertically adjustable brushes 34 are arranged behind the broom arrangement in the operating direction at the rear end of machine frame 5 for sweeping ballast away from rail fastening elements, a hydraulic vertical adjustment drive 33 connecting each brush to the machine frame. In this manner, any ballast dammed behind wall 15 and forced to the sides over rail fastening elements will be rapidly swept away to uncover rail spikes and tie plates that may have been covered by such laterally displaced ballast.

As will be described in more detail in connection with FIG. 3, each center plowshare 13 is laterally pivotal about vertically extending, transversely displaceable pivot 35 (see full and chain-dotted lines in FIG. 2), ballast scraping and damming wall 15 defining a transversely extending guide track 46 for transversely displaceably guiding each pivot, and drive means 49 is capable of transversely displacing each pivot. Pivoting and transverse adjustment of center plowshares 13 enables the center plow to be adjusted into various operating positions for deflecting the ballast into desired directions without interfering with the ballast damming and storing action of wall 15. Further desired redirections of the ballast flow may be obtained by suitably pivoting side plowshares 14 about their pivots 36.

Ballast scraping and damming wall 15 has a vertically extending wall section receiving pivots 35 of center plowshares 13 and substantially horizontally extending intermediate wall section 37 leading to upper edge 22 of the wall. Drive 21 of ballast conveyor band 23 is reversible (see arrows in full and dotted lines in FIG. 2) to enable the ballast to be discharged at a selected track shoulder. One end of ballast scraping sheet metal member 30 is linked to a carrier structure of conveyor band 23 for pivoting about transversely extending axis 38 while an intermediate portion of the sheet metal member is linked to carrier frame 28 of broom 26 for pivoting about transversely extending axis 39 which is spaced from pivoting axis 38. This pivotal support of ballast scraping sheet metal member 30 enables the broom and the sheet metal member to be readily adjusted between an operating position and a raised rest position when the machine is moved between operating sites. Support rollers 31 for sheet metal member 30 are vertically adjustable so that they may be adapted to different rail heights.

As can be seen in FIG. 2, the lower edge of ballast scraping sheet metal member 30 behind support rollers 31 has recesses 40 to permit rails 3 to pass therethrough without touching the sheet metal member.

Figures 3, 4, 5, 6, 7, 8:
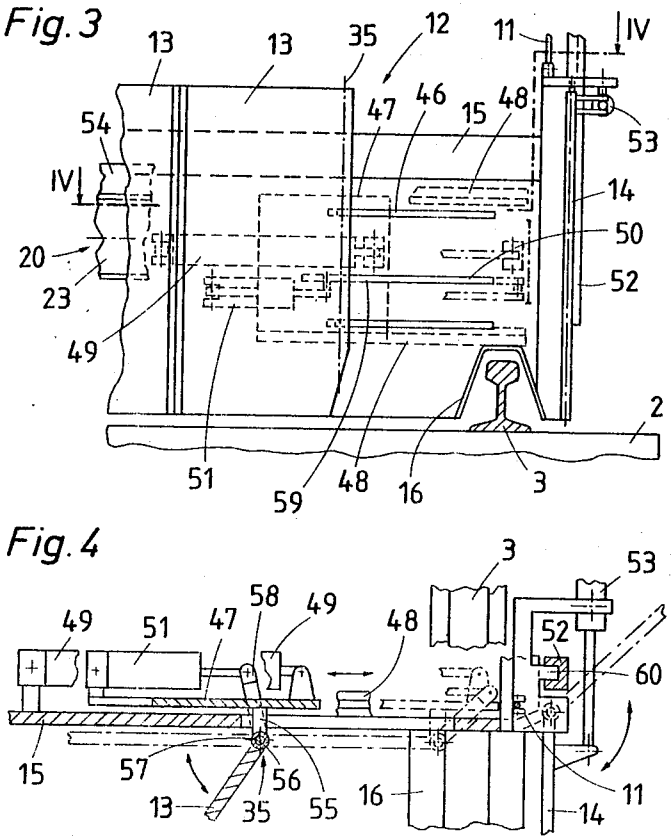
FIG. 3 is a front view of the center plow with center and side plow blades and the ballast scraping and damming wall, taken along line III—III of FIG. 1.
FIG. 4 is an enlarged top view of the center plow, taken along line IV—IV of FIG. 3, and FIGS. 5 to 8 strictly diagrammtically illustrate the ballast scraping and damming wall and the succeeding transverse conveyor band with differential operational positions of the plow blades and of the shoulder plows.

As shown in the enlarged fragmentary front view of FIG. 3 illustrating half the ballast scraping and damming wall 15, the lower vertical wall section defines two horizontally extending guide slots 46 constituting the guide track for transversely displaceably mounting pivot 35 for center plowshare 13. Studs passing through the guide slots connect the pivot to a guide plate 47 which is mounted on the opposite side of the lower vertical wall section for transverse displacement along guides 48 in the opposite side. Transverse displacement drive 49 connects the opposite lower vertical wall section side to guide plate 47 for transversely displacing the guide plate with pivot 35 and center plowshare 13 affixed thereto. Another horizontal slot 50 is defined in the lower vertical wall section between guide slots 46. To enable the center plowshare to be pivoted about the vertical axis of pivot 35, pivoting drive 51 connects the center plowshare to guide plate 47. The lateral end of wall 15, to which side plowshare 14 is connected, is vertically displaceably mounted in vertical guide 52 affixed to machine frame 5. Pivoting drive 53 is connected to side plowshare 14 for laterally adjusting the same. Conveyor band 23 is fragmentarily seen behind wall 15 in FIG. 3, which shows a guide sheet metal member 54 extending alongside the upper course of the conveyor band for preventing ballast conveyed by the conveyor band from spilling over the side of the conveyor band. The lower end of vertical adjustment drive 11 is linked to the plow arrangement unit comprising center plow blades 13, side plowshares 14, tunnel-shaped elements 16 and wall 15.

As shown in FIG. 4, stud 55 passing through guide slot 46 connects guide plate 47 and vertical pivot rod 56. This rod extends through pivot sleeve 57 connected to center plowshare 13 to constitute pivot 35. The pivot sleeve defines arcuate bores through which studs 55 pass, the bores extending over a quarter of a circle so that the center plowshare may be pivoted through an angle of 90°. Roughly intermediate its ends, guide sleeve 57 is connected to one end of link 58 extending through horizontal slot 50 in wall 15, the opposite link end being connected to pivoting drive 51. Guide plate 47 has a cut 59 for receiving link 58 so that this link may be readily pivoted through an angle of 90°. The lateral end of wall 15 has a vertical guide ledge 60 received in U-shaped vertical guide 52 affixed to machine frame 5 so that the wall may be vertically displaced along this guide.

It will be understood by those of ordinary skill in the art that means 20 for removing any excess ballast flowing over upper wall edge 22 need not be a transverse conveyor band, as illustrated herein by way of example, but may be constituted by any other suitable ballast removal and discharge means, such as a transverse and obliquely descending chute or a transverse elongated trough holding a rotary conveyor screw or the like. Also, ballast scraping and damming wall 15 may be vertically adjustable independently of ballast plow arrangement 12.

The operation of machine 1 will be apparent from the above-described structure of the machine and various aspects thereof will be described in detail hereinafter.

After the machine has reached its operating site, ballast plow arrangement 12 with center plowshares 13, side plowshares 14, ballast scraping and damming wall 15 and rail-bridging tunnel-shaped elements 16 will be vertically displaced by hydraulic drives 11 along vertical guides 52 into the lowered operating position. At the same time, vertical adjustment drives 25 are actuated to lower the broom arrangement with carrier frame 28 and broom 26 from its upper rest position shown in chain-dotted lines in FIG. 1 to its operating position shown in full lines. This will automatically cause ballast scraping sheet metal member 30 pivoted to the carrier frame to be lowered until its support rollers 31 engage track rails 3. Vertical adjustment drives 33 are also actuated to lower brushes 34 into the operating position for sweeping any ballast away from rail spikes and tie plates. Drives 19 and 42 are actuated for vertical adjustment of shoulder plow 17 and to displace shoulder plowshares 45 into their outward operating positions, as shown in chain-dotted lines in FIG. 2. Pivoting drives 44 are used to position shoulder plowshares at a desired angle with respect to the railroad track. Transverse displacement drives 49 are actuated until center plowshares 13 have reached a desired transverse position with respect to track rails 3, and pivoting drives 51 are then actuated until the center plowshares have reached a desired operating angle with respect to railroad track 4, for instance a V-shaped configuration, as shown in full lines in FIG. 2. Finally, pivoting drives 53 are actuated to position side plowshares 14 at a desired angle, such as shown in chain-dotted lines in FIG. 2. After drive 29 for rotating broom 26 and drive 21 for moving conveyor band 23 are actuated, machine 1 is ready for operation.

Through a suitable positioning of shoulder plowshares 45, side plowshares 14 and center plowshares 13, a desired portion of the ballast is pushed from the track shoulders inwardly and towards ballast scraping and damming wall 15 as the machine advances in the operating direction indicated by arrow 7. The ballast between rails 3 is pushed outwardly in the direction of the intersections between the rails and ties 2 where the rails rest on the ballast bed when center plowshares 13 are in the V-shaped formation shown in full lines in FIG. 2. This causes sufficient ballast to be present in the cribs in the regions where the track is supported on the ballast bed. Excessive ballast is dammed and stored behind advancing wall 15. This stored supply of ballast will serve automatically to fill any cribs which require additional ballast with sufficient ballast to provide a substantially uniform filling of all cribs with the desired amount of ballast. Any excess amount of ballast not needed for filling the successive cribs will flow over intermediate wall section 37 and upper wall edge 22 onto transverse conveyor band 23. The moving band will remove this excess ballast to one of the track shoulders where it is discharged. Any ballast deposited on ties 2 is guided upwardly by scraping sheet metal member 30 whose lower edge is in contact with the tie surfaces and will be deposited by member 30 on the conveyor band.

If ballast conditions require changes in the flow directions of the ballast, the various plowshares may be pivoted into corresponding positions without stopping the machine's advancement.

In the operating position of ballast plow arrangement 12 illustrated diagrammatically in FIG. 5, pivots 35 of center plowshares 13 have been transversely displaced to their laterally outermost positions at tunnel-shaped elements 16 and the center plowshares have been pivoted inwardly into a transverse vertical plane extending parallel to wall 15. One side plowshare 14 at one track shoulder has been pivoted to extend forwardly of the center plowshares in the operating direction while the side plowshare at the opposite track shoulder has been pivoted to trail the center plowshares. This will cause the ballast plowed at the one track shoulder by shoulder plow 17 to flow to the opposite track shoulder in the direction of the long arrow shown in this figure. Any ballast overflowing the upper edge of wall 15 (see small horizontal arrows) may also be moved to this opposite track shoulder by conveyor band 23 (see small vertical arrow).

In the operating position illustrated in FIG. 6, center plowshares 13 have been pivoted forwardly in the operating direction to extend parallel to track rails 3. As shown by the two long arrows, this will cause the plowed shoulder ballast to flow towards the intersections of the ties and rails, where the ballast may subsequently be tamped under the ties, while the center of the ballast bed receives no ballast. In this position, the center plowshares cooperate with side plowshares 14 to funnel the plowed ballast exclusively in this direction.

FIG. 7 shows center plowshares 13 in the same operating position as in FIG. 5 but both side plowshares 14 are forwardly pivoted. In this operating position, ballast plow arrangement 12 serves fully to store the plowed ballast so that the cribs may be uniformly filled with ballast over their entire width.

In the operating position of ballast plow arrangement 12 shown in FIG. 8, center plowshares 13 are pivoted towards each other into a V-formation while side plowshares 14 are pivoted backwardly to extend substantially parallel to the center plowshares. This will cause the ballast plowed by shoulder plow 17 to flow from the center of the ballast bed towards the two track shoulders in the direction of the long arcuate arrows.

Obviously, any variations of the illustrated plowshare positions may be used to obtain a desired ballast flow.

What is claimed is:

1. A mobile machine for distributing and shaping the ballast bed of a railroad track consisting of two rails fastened to ties, which comprises:

(a) a machine frame, (b) two undercarriages supporting the machine frame on the track for mobility thereon in an operating direction, (c) a ballast plow arrangement comprising (1) a ballast planing plow including two vertically adjustable center plowshares arranged between the rails and (2) a respective rail-bridging tunnel-shaped element associated with each rail and embracing the associated rail, (d) drive means for vertically adjustably connecting the ballast plow arrangement to the machine frame, (e) a vertically adjustable, transversely extending ballast scraping and damming wall connected to the machine frame and arranged between the tunnel-shaped elements immediately behind the center plow blades in the operating direction, the wall having an upper edge, and (f) means connected to the machine frame and arranged immediately behind the ballast scraping and damming wall for removing any ballast flowing over the upper edge of the wall.

2. The mobile machine of claim 1, wherein the ballast scraping and damming wall is connected to the ballast planing plow for common vertical adjustment and extends over the entire transverse distance between the tunnel-shaped elements.

3. The mobile machine of claim 1, wherein the ballast scraping and damming wall has a vertical height corresponding to at least twice the height of the tunnel-shaped elements, and the center plowshares have a vertical height exceeding the height of the wall.

4. The mobile machine of claim 1, wherein the means for removing any ballast flowing over the upper edge of the wall comprises a conveyor band extending transversely below the upper wall edge and having a length corresponding at least to the length of the wall, and a drive for moving the conveyor band.

5. The mobile machine of claim 1, wherein the plow arrangement, the ballast scraping and damming wall and the means for removing any ballast flowing over the upper edge of the wall are arranged between the undercarriages.

6. The mobile machine of claim 1, further comprising a vertically adjustable broom arrangement mounted behind the ballast plow arrangement, the ballast scraping and damming wall and the means for removing any ballast flowing over the upper edge of the wall, and drive means vertically adjustably connecting the broom arrangement to the machine frame.

7. The mobile machine of claim 6, further comprising a transversely extending ballast scraping sheet metal member arranged between the means for removing any ballast flowing over the upper edge of the wall and the broom arrangement, and rollers supporting the ballast scraping sheet metal member on the track rails.

8. The mobile machine of claim 7, further comprising a carrier frame for the broom arrangement and the ballast scraping sheet metal member, the sheet metal member having one end linked to the means for removing any ballast flowing over the upper wall edge for pivoting about a transversely extending axis while an intermediate portion of the sheet metal member is linked to the carrier frame for pivoting about a transversely extending axis spaced therefrom for pivoting thereabout.

9. The mobile machine of claim 6, further comprising two transversely spaced, vertically adjustable brushes arranged behind the broom arrangement in the operating direction for sweeping ballast away from rail fastening elements.

10. The mobile machine of claim 1, further comprising vertically adjustable drive means connecting the ballast plow arrangement to the machine frame, each center plowshare being laterally pivotal about a vertically extending, transversely displaceable pivot, a transversely extending guide track in the ballast scraping and damming wall for transversely displaceably guiding each pivot, and drive means for transversely displacing each pivot.

11. The mobile machine of claim 1, further comprising a respective side plowshare preceding the ballast scraping and damming wall in the operating direction and transversely spaced from each center plowshare, the side plowshares being pivotal about vertical axes for lateral adjustment, and a vertically and transversely adjustable shoulder plow preceding the ballast plow arrangement in the operating direction.

* * * * *